US010228214B1

(12) United States Patent
Rich et al.

(10) Patent No.: US 10,228,214 B1
(45) Date of Patent: Mar. 12, 2019

(54) FIXED STOCK ADAPTER

(71) Applicants: Robert L. Rich, Victor, NY (US); Alisha M. Rich, Victor, NY (US)

(72) Inventors: Robert L. Rich, Victor, NY (US); Alisha M. Rich, Victor, NY (US)

( * ) Notice: Subject to any disclaimer, the term of this patent is extended or adjusted under 35 U.S.C. 154(b) by 0 days.

(21) Appl. No.: 15/690,681

(22) Filed: Aug. 30, 2017

(51) Int. Cl.

| | |
|---|---|
| ***F41C 23/00*** | (2006.01) |
| ***F41C 23/12*** | (2006.01) |
| ***F41C 23/20*** | (2006.01) |
| *F41C 7/00* | (2006.01) |

(52) U.S. Cl.
CPC ..... *F41C 23/12* (2013.01); *F41C 23/20* (2013.01); *F41C 7/00* (2013.01)

(58) Field of Classification Search
CPC ..... F41C 23/20; F41C 23/12; F41C 23/00
USPC ..... 42/71.01, 72, 75.03
See application file for complete search history.

(56) References Cited

U.S. PATENT DOCUMENTS

| | | | | |
|---|---|---|---|---|
| 7,886,473 | B2 | 2/2011 | Rothärmel | |
| 8,381,427 | B2 | 2/2013 | Nill | |
| D716,405 | S | 10/2014 | Storey | |
| D716,406 | S | 10/2014 | Storey | |
| D726,862 | S | 4/2015 | Crume, Sr. | |
| D726,863 | S | 4/2015 | Crume, Sr. | |
| 9,127,905 | B2 | 9/2015 | Schreckenstein et al. | |
| 9,568,273 | B2 | 2/2017 | Thordsen | |
| 2003/0140542 | A1* | 7/2003 | Kay | F41C 23/16 42/75.03 |
| 2007/0089347 | A1* | 4/2007 | Webber | F41A 11/02 42/75.03 |
| 2009/0126249 | A1 | 5/2009 | Crommett | |
| 2014/0144060 | A1 | 5/2014 | Thordsen | |
| 2015/0300774 | A1* | 10/2015 | Wheaton | F41C 23/12 42/72 |

* cited by examiner

*Primary Examiner* — J. Woodrow Eldred
(74) *Attorney, Agent, or Firm* — Barclay Damon LLP

(57) ABSTRACT

A fixed stock adapter for a receiver of a fire arm comprises a receiver engagement portion disposed at a top end of the fixed stock adapter that further comprises two opposing sides configured to couple to a portion of the receiver of a firearm. A transition portion of the receiver engagement portion is configured to contact a portion of a fixed stock accessory and be congruent with the portion of the fixed stock accessory. A spine is further configured to couple to the two opposing sides and the transition portion. An accessory engagement portion is coupled to the spine and comprises one or more accessory engagement surfaces configured to fit within the fixed stock accessory and at least one coupling feature configured to receive a coupling element. The coupling element configured to engage a coupling feature on the fixed stock accessory.

20 Claims, 14 Drawing Sheets

FIXED STOCK ADAPTER

TECHNICAL FIELD

This application is generally directed to the field of fire arms and more specifically to a device that allows for modification of a pistol grip AK-47 rifle to meet current safety regulations by adapting a horizontal fixed stock for an AR-15 semi-automatic rifle to fit an AK-47.

BACKGROUND

Gun ownership is something that many people have in common in the United States. However, there has always been a tension between the right to bear arms and the regulation of said arms to promote their safe operation by authorized users. The amount of regulations affecting gun ownership is voluminous and has evolved over many decades with many states having enacted their own gun laws on top of the existing federal structure. Some of these state laws are directed to the classification of guns, which impacts who may own certain types of firearms or whether at all. These state laws tend to be more stringent and may involve increasing the use of background checks, further regulation or banning of certain features on a firearm, and even totally banning particular types of firearms and ammunition.

For example, some states have banned the sale of semi-automatic rifles with magazines that can be quickly detached by pressing a button. Other states have passed legislation that requires the registration of certain types of firearms as "assault weapons". Classification of a fire arm as an "assault weapon" generally restricts their access, possession, and transfer. Some of the features that cause a firearm to be classified as an "assault weapon" are, for example, a folding or telescopic stock, a pistol grip, a second hand grip, a flash suppressor, and a threaded barrel configured to accommodate a flash suppressor. Accordingly, it is desirable for owners of guns that would be classified as "assault weapons" to modify them such that they become compliant with their state's regulations and hence fall outside the classification of an "assault weapon".

Modifying or sporterizing firearms to remove some or all of these offending features is a growing market and many different accessories to make firearms compliant with gun regulations are becoming available. One popular accessory for owners of AR-15 semi-automatic rifles is a fixed stock and grip that is complaint with the current gun regulations and replaces the gun's typical telescopic stock and pistol grip. An example of such a fixed stock is disclosed in U.S. Pat. No. 9,568,273. Models of AK-47 rifles generally include one or more of the offending features such as a pistol grip. Unfortunately, many of the accessories used to sporterize firearms to make them compliant with gun regulations have not been tailored to be compatible with AK-47 rifles. Consequently, it is virtually impossible to legally own such a gun in many jurisdictions.

The foregoing background describes some, but not necessarily all, of the problems, disadvantages and shortcomings related to firearm accessories designed to make firearms compliant with gun laws. There is a general and pervasive need in the field to provide a firearm accessory to enable AK-47 gun owners to sporterize their gun to make it compliant with the existing gun regulations.

SUMMARY

An embodiment of a fixed stock adapter for a fire arm comprises a receiver engagement portion disposed at a top end. The receiver engagement portion comprises two opposing sides configured to couple to a portion of a receiver of a firearm. A transition portion of the receiver engagement portion is configured to contact a portion of a fixed stock accessory and be congruent with the portion of the fixed stock accessory. A spine is further configured to couple to the two opposing sides and the transition portion. An accessory engagement portion is disposed at a bottom end and is coupled to the spine. The accessory engagement portion comprises one or more accessory engagement surfaces configured to fit within the fixed stock accessory and at least one coupling feature configured to receive a coupling element. The coupling element is configured to engage a coupling feature on the fixed stock accessory.

In another embodiment, a receiver for a firearm comprises a first end defining an opening configured to receive a portion of a barrel and a second end opposing the first end. The second end further comprises a fixed stock adapter portion. The fixed stock adapter comprises a receiver engagement portion comprising two opposing sides configured to couple to the portion of the receiver. A transition portion of the fixed stock adapter portion is configured to contact a portion of a fixed stock accessory and is congruent with the portion of the fixed stock accessory. A spine is configured to couple to the two opposing sides and the transition portion and an accessory engagement portion is coupled to the spine and disposed under the receiver engagement portion. The accessory engagement portion further comprises one or more accessory engagement surfaces that are configured to fit within the fixed stock accessory and at least one coupling feature configured to receive a coupling element. The coupling element is configured to engage a coupling feature on the fixed stock accessory.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

The following discussion relates to various embodiments of a fixed stock adapter. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", and the like are not intended to limit these concepts, except where so specifically indicated. As used herein, the terms "about" and "approximately" are meant to encompass a range of values from 80-125% of the claimed or disclosed value. With regard to the drawings, their purpose is to depict salient features of the inventive fixed stock adapter and are not specifically provided to scale.

Figure 1:
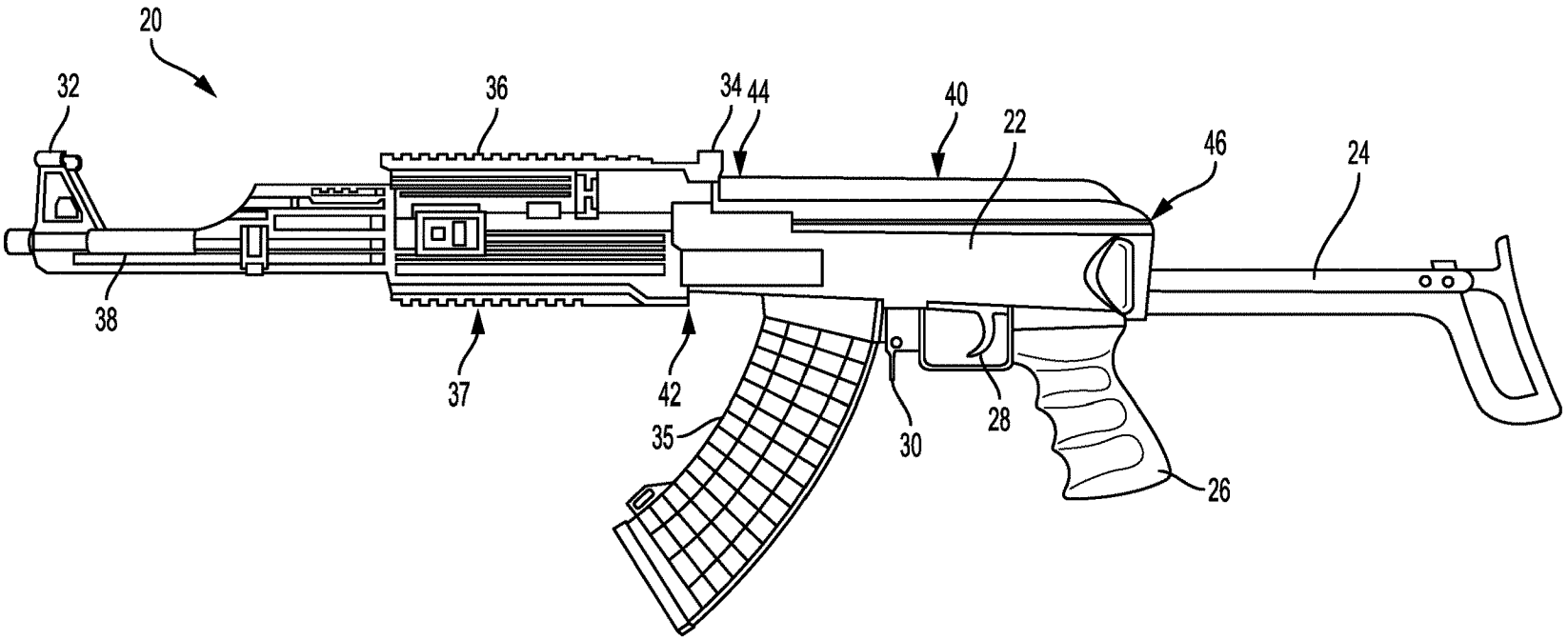
FIG. 1 PRIOR ART
FIG. 1 illustrates a prior art embodiment of an AK-47 rifle.

Referring to FIG. 1, an embodiment of an AK-47 firearm 20 generally comprises the receiver 22, stock 24, and a barrel 38. As shown, the receiver 22 has a top 40, a bottom 42, and extends along an axis from a butt end 46 to a barrel end 44. The butt end 46 of the receiver 22 is configured to engage or couple to the stock 24. The top 40 may comprise a back sight 34 proximate the barrel end 44 that is configured to cooperate with a front sight 32 to aid the user in aiming the firearm 20. A pistol grip 26 is coupled to the bottom 42 proximate the butt end 46 of the receiver 22. A magazine 35 is also coupled to the bottom 42 in order to provide a supply of ammunition. As shown, a trigger 28 may be generally disposed between the pistol grip 26 and the magazine 35 with a safety button 30 or mechanism in close proximity to the trigger 28. Still referring to FIG. 1, a barrel 38 extends from the barrel end 44 of the receiver 22 and may be configured to support the front sight 32.

A barrel jacket 36 may be configured to surround at least a portion of the barrel 38 and may be configured to be held by the user to stabilize and aim the firearm 20. As shown, a hand guard 37 is disposed below the barrel jacket 36. As shown in FIG. 1, the stock 24 of the firearm 20 is an adjustable stock which extends from the butt end 46 of the receiver 22 and is configured to adjust in length to better fit the user. In one embodiment, the stock 24 may adjust using a folding action and in another embodiment, the stock 24 may adjust using a telescopic action. Adjustable stocks or a stock 24 that is adjustable and pistol grips 26 are some of the features that cause a firearm to be classified as an "assault weapon" and subject to additional restrictions and regulations in many states. Therefore, it is desirable for owners of such firearms to replace the stock 24 that is adjustable and pistol grip 26 with a fixed stock and non-pistol grip that are compliant with the local gun regulations.

Figure 2:
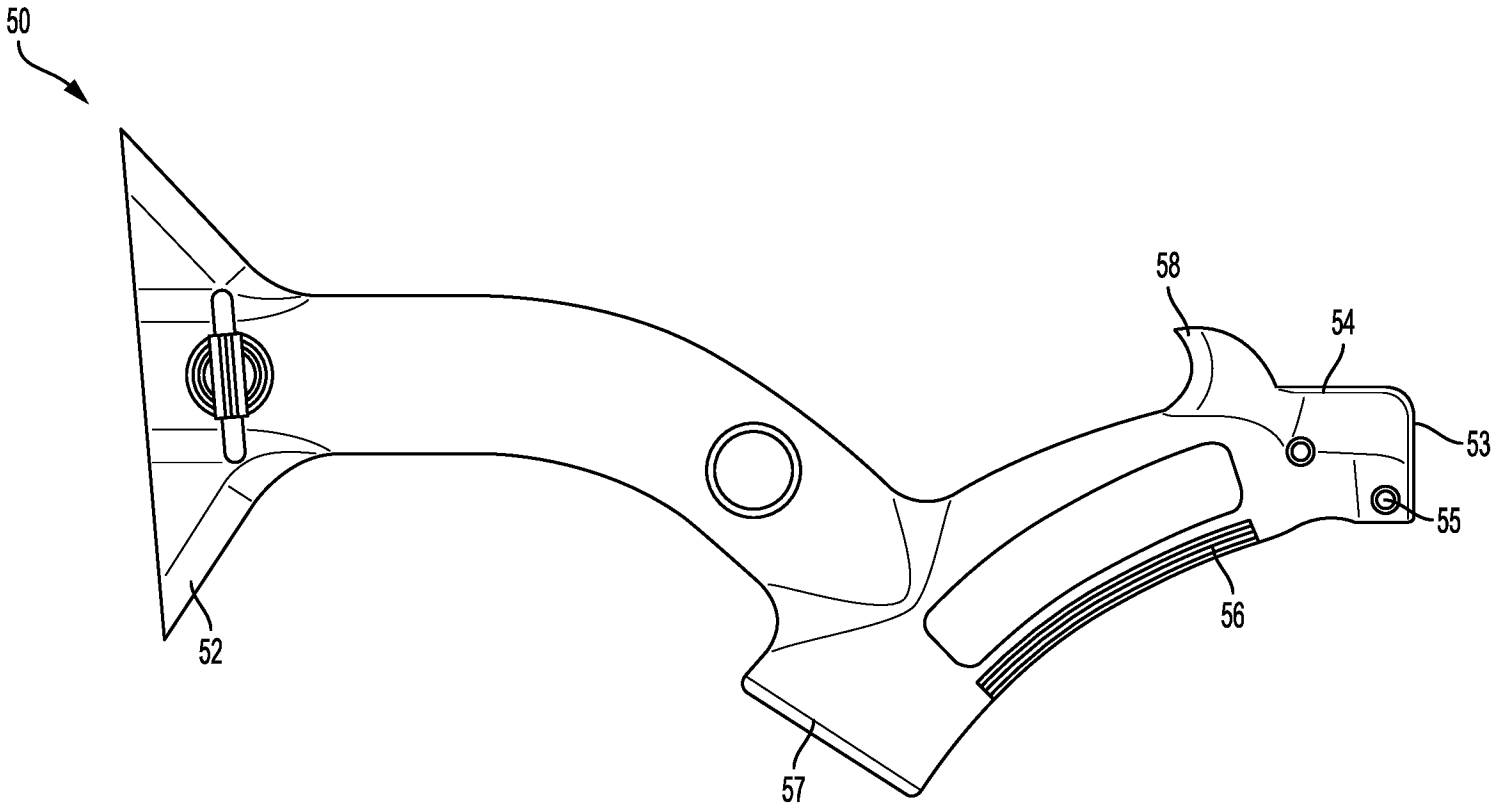
FIG. 2 PRIOR ART
FIG. 2 illustrates a prior art embodiment of a fixed stock accessory for an AR-15 semi-automatic rifle.

As shown in FIG. 2, fixed stock accessories 50 are available for other types of firearms such as an AR-15 rifle. An example of such an accessory is disclosed in U.S. Pat. No. 9,568,273 and illustrated in FIG. 2. The fixed stock accessory 50 is designed to replace the adjustable stock and the pistol grip of the AR-15 firearm. The fixed stock accessory 50 generally comprises a butt 52 that is contoured or curved to avoid or bypass other existing elements of the AR-15 firearm. The butt 52 is further coupled to the base 57 of the grip 56. The grip 56 is disposed at an angle relative to the axis of the receiver 22 (FIGS. 1 and 7) that is not 90°. The grip 56 is used in conjunction with the hand rest 58 to hold and secure the firearm without the user being able to wrap their fingers completely around the grip 56. As shown, the fixed stock accessory 50 couples to an AR-15 receiver (not shown) at one or more engagement surfaces 53, 54 using one or more fastening members (not shown) at one or more coupling points 55. The hand rest 58 is disposed proximate an upper receiver engagement surface 54 and acts to create a smooth transition between the firearm and the accessory as well as being configured to rest between the thumb and index finger of the user to provide a comfortable and stable grip position. The fixed stock accessory 50 allows owners of certain models of firearms that are classified in some states as "assault weapons" to legally modify them so they are no longer classified as such and consequently no longer subject to additional regulations. However, the fixed stock accessory 50 is not compatible with all targeted firearms, and specifically is not compatible with AK-47 rifles.

Referring to FIGS. 3-6, a fixed stock adapter 100 is configured to couple the fixed stock accessory 50 (FIG. 2) to the receiver 22 (FIGS. 1 and 7) of an AK-47. The fixed stock adapter 100 has a top 106, a bottom 108, and generally comprises a receiver engagement portion 110 and an accessory engagement portion 130.

Figure 3:
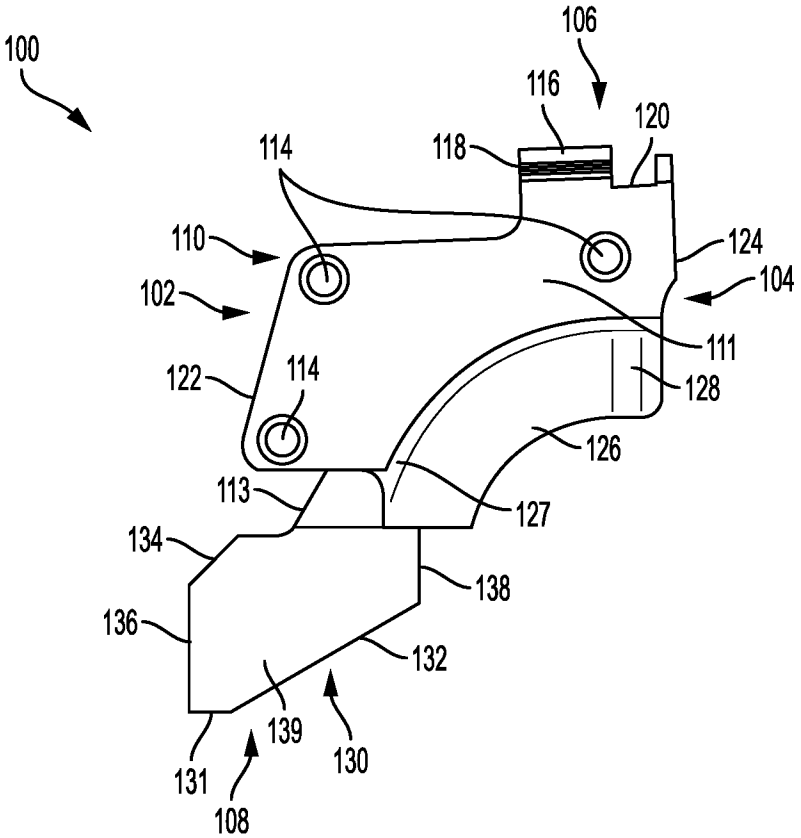
FIG. 3 illustrates a side plan view of an embodiment of a fixed stock adapter.
Figure 4:
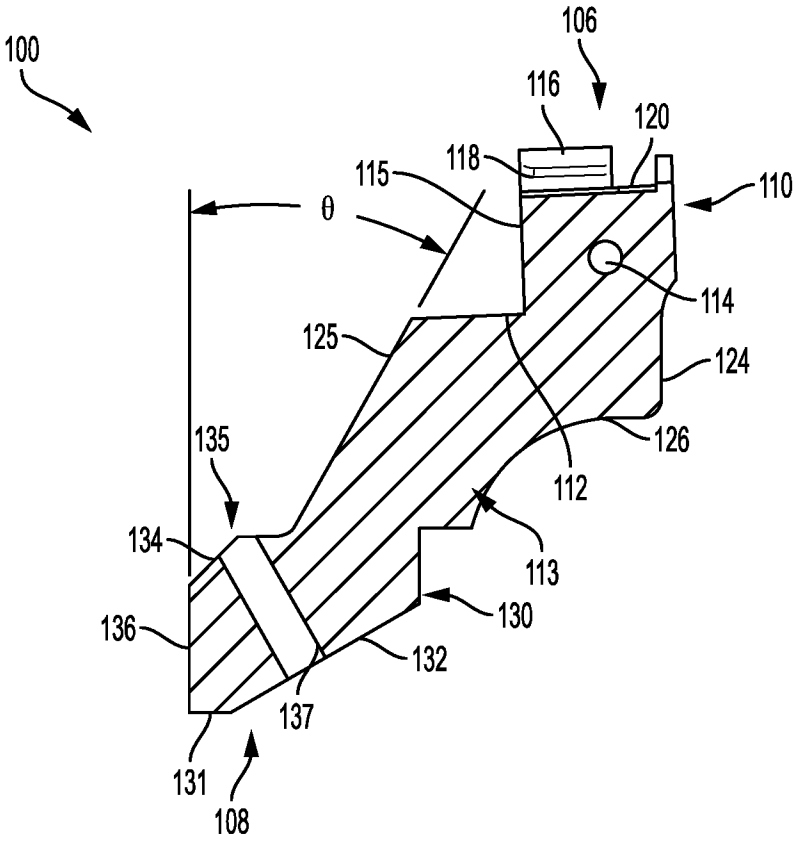
FIG. 4 illustrates a cross sectional view of an embodiment of the fixed stock adapter.
Figure 5:
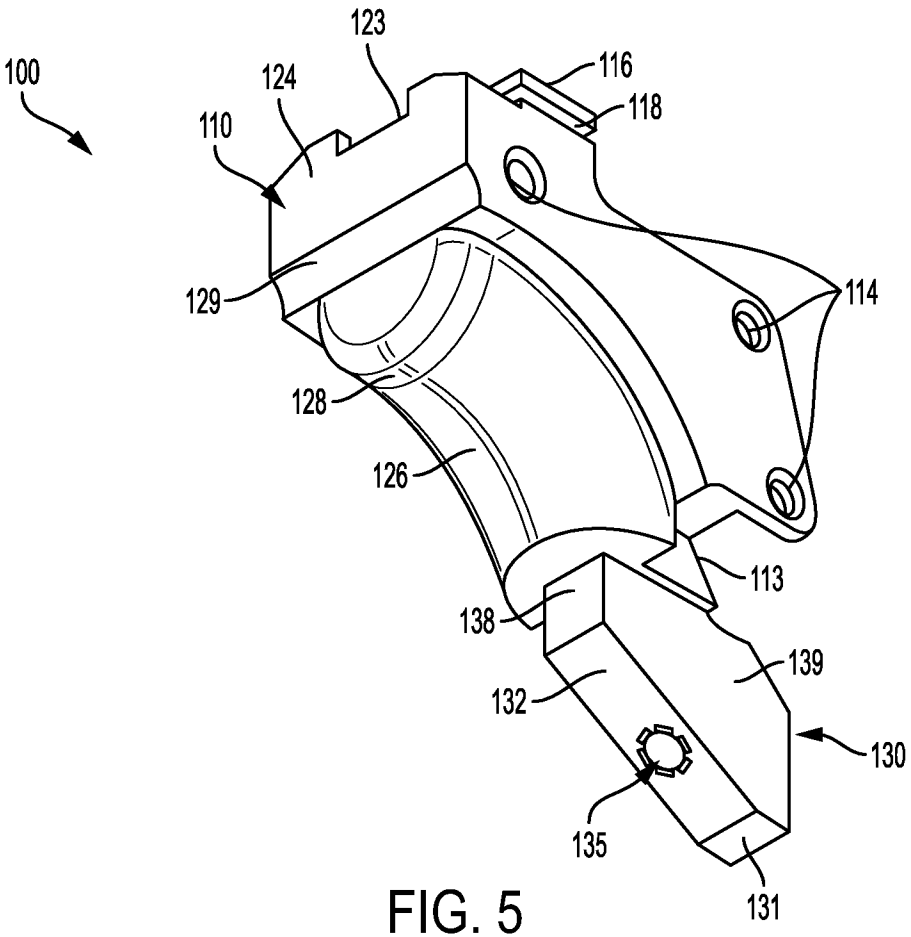
FIG. 5 illustrates an isometric bottom view of an embodiment of the fixed stock adapter.
Figure 6:
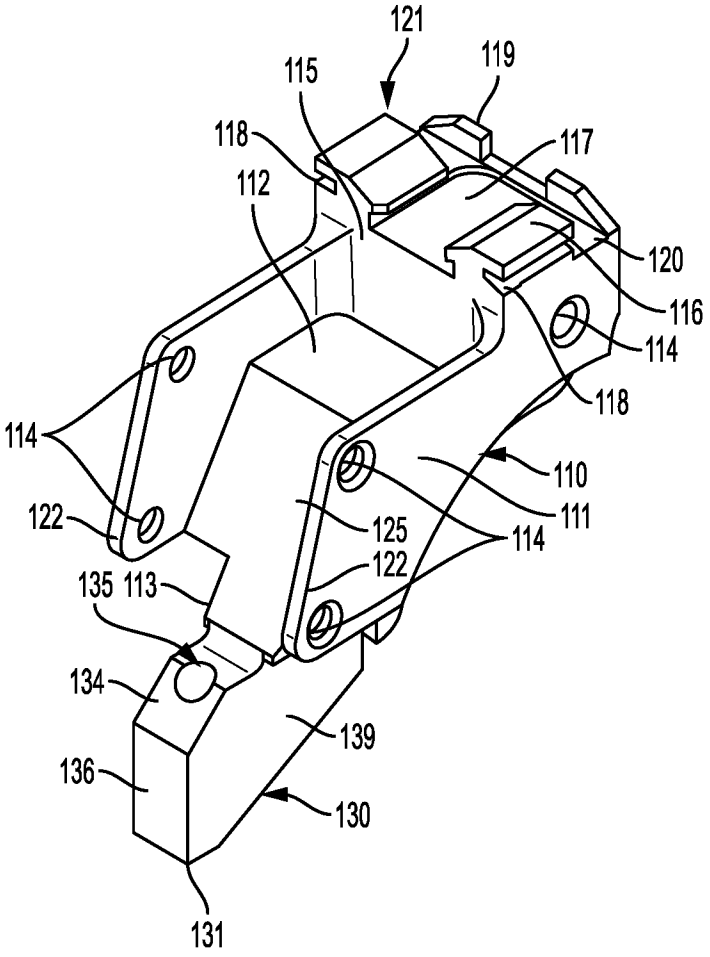
FIG. 6 illustrates an isometric top view of an embodiment of the fixed stock adapter.
Figure 7:
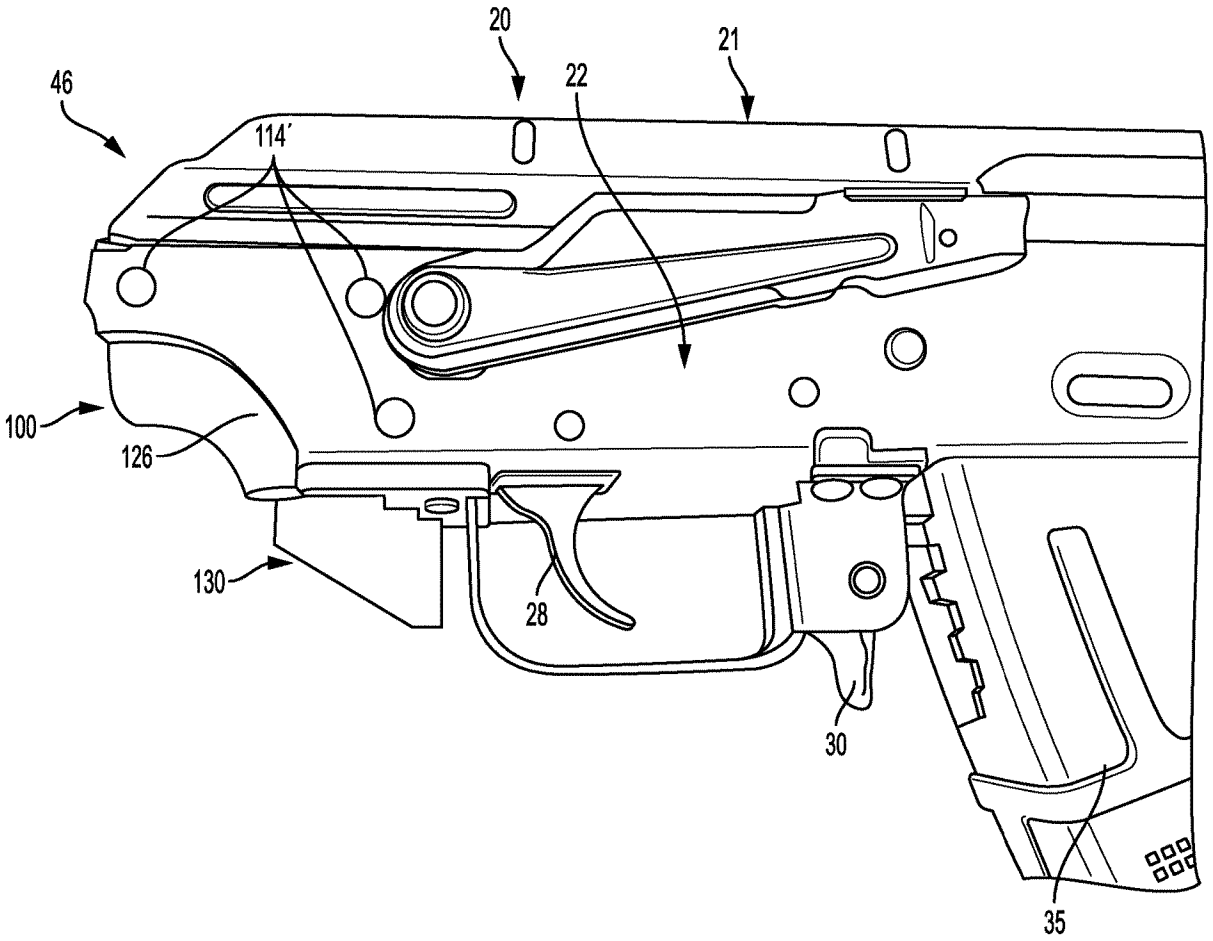
FIG. 7 illustrates an embodiment of the fixed stock adapter coupled to the butt end of a receiver of an AK-47 rifle.

The receiver engagement portion 110 may comprise a spine 113 that extends from the top 106 towards the bottom 108. A forward facing end 102 may comprise at least one forward facing surface 125 (FIGS. 4 and 6) and the rearward facing end 104 may further comprise a rearward facing surface 124 (FIGS. 3 and 5). In the installed state, the forward facing surface 125 may generally face the barrel end 44 (FIG. 1) of the receiver 22 (FIGS. 1 and 7) and the rearward facing surface 124 may generally face or define the butt end 46 (FIG. 1) of the receiver 22 (FIGS. 1 and 7). In an embodiment, the fixed stock adapter 100 may comprise more than one forward facing surface 125. In a further embodiment, the forward facing surface 125 may be an angled surface that defines an upper surface of the spine 113.

In an embodiment, opposing wings or sides 111 may be attached to opposing sides of the spine 113 and can extend in a forward direction from the rearward facing surface 124. The opposing sides 111 may define one or more holes 114 configured to accept a rivet or other mechanical fastener to couple the fixed stock adapter 100 to the receiver 22 (FIGS. 1 and 7) of the firearm 20 (FIG. 1). As shown in FIGS. 3 and 6, each opposing side 111 includes a hole 114 proximate the rearward facing surface 124 and two holes 114 proximate an angled forward surface 122. The opposing sides 111 couple to the receiver 22 (FIGS. 1 and 7) at or proximate the butt end 46 (FIG. 1) of the receiver 22 (FIG. 1).

Figure 9:
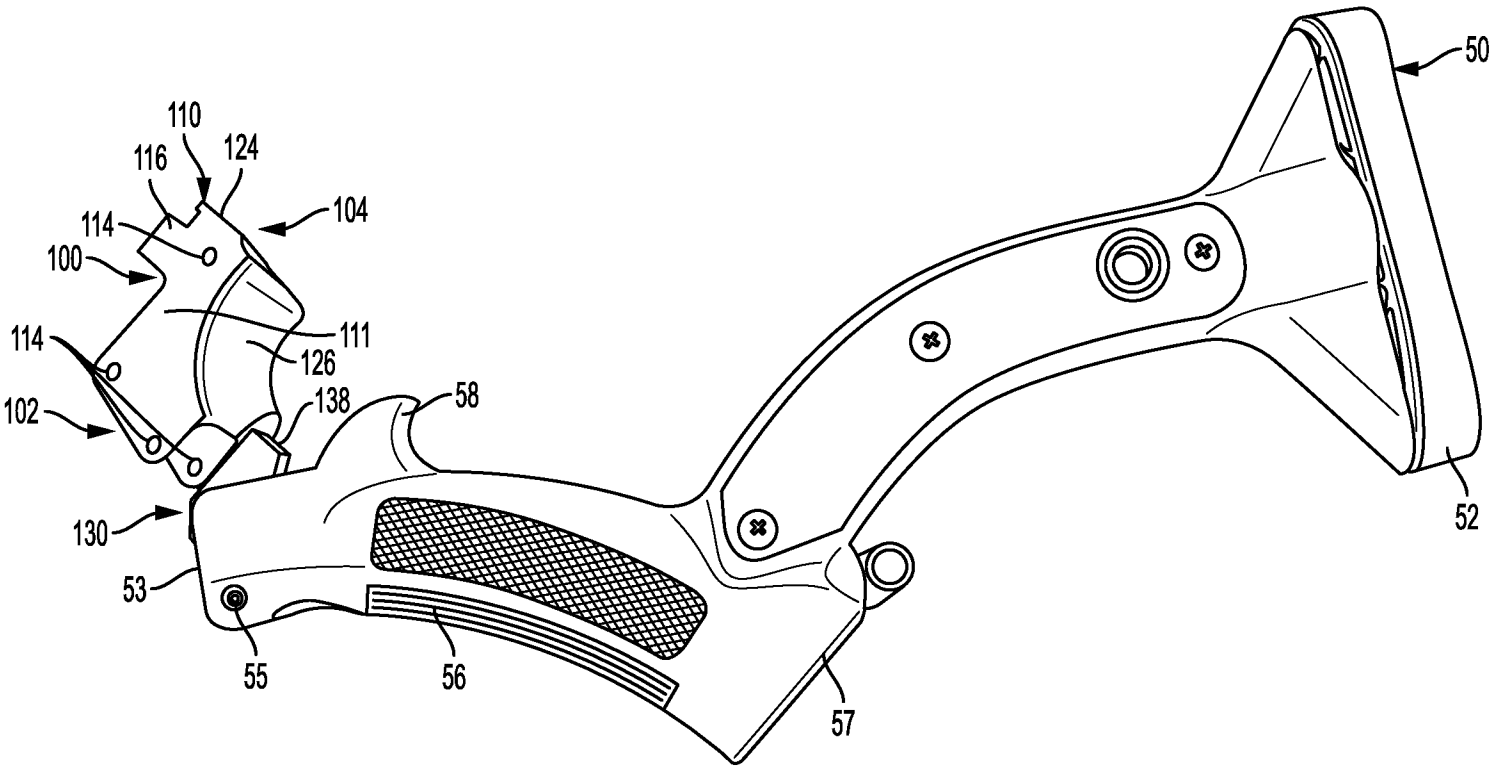
FIG. 9 illustrates an embodiment of the fixed stock adapter partially installed onto the embodiment of the fixed stock accessory of FIG. 3.

In an embodiment, the opposing sides 111 also comprise one or more surface features that may be configured to engage another portion of the receiver 22 (FIGS. 1 and 7). As shown in FIGS. 3-6, the surface features may comprise one or more grooves or recesses 118, lips 116, and notches 120, 121 (FIG. 5) proximate the top 106. In an embodiment, the one or more surface features may be configured to engage a portion of the firing mechanism of the gun or firearm. In another embodiment, the surface features may not be proximate the top 106. In still another embodiment, the one or more lips 116 and the one or more grooves 118 may be disposed or formed on an extension portion 121 that extends from at least one of the opposing sides 111 towards the top 106 of the fixed stock adapter 100. As shown in FIG. 9, a bevel 129 or other surface feature may be disposed between the rearward facing surface 124 and the transition portion 126. The bevel may be configured to engage a portion of the receiver 22 (FIGS. 1 and 7) while other embodiments may not include a bevel 129.

Figure 10:
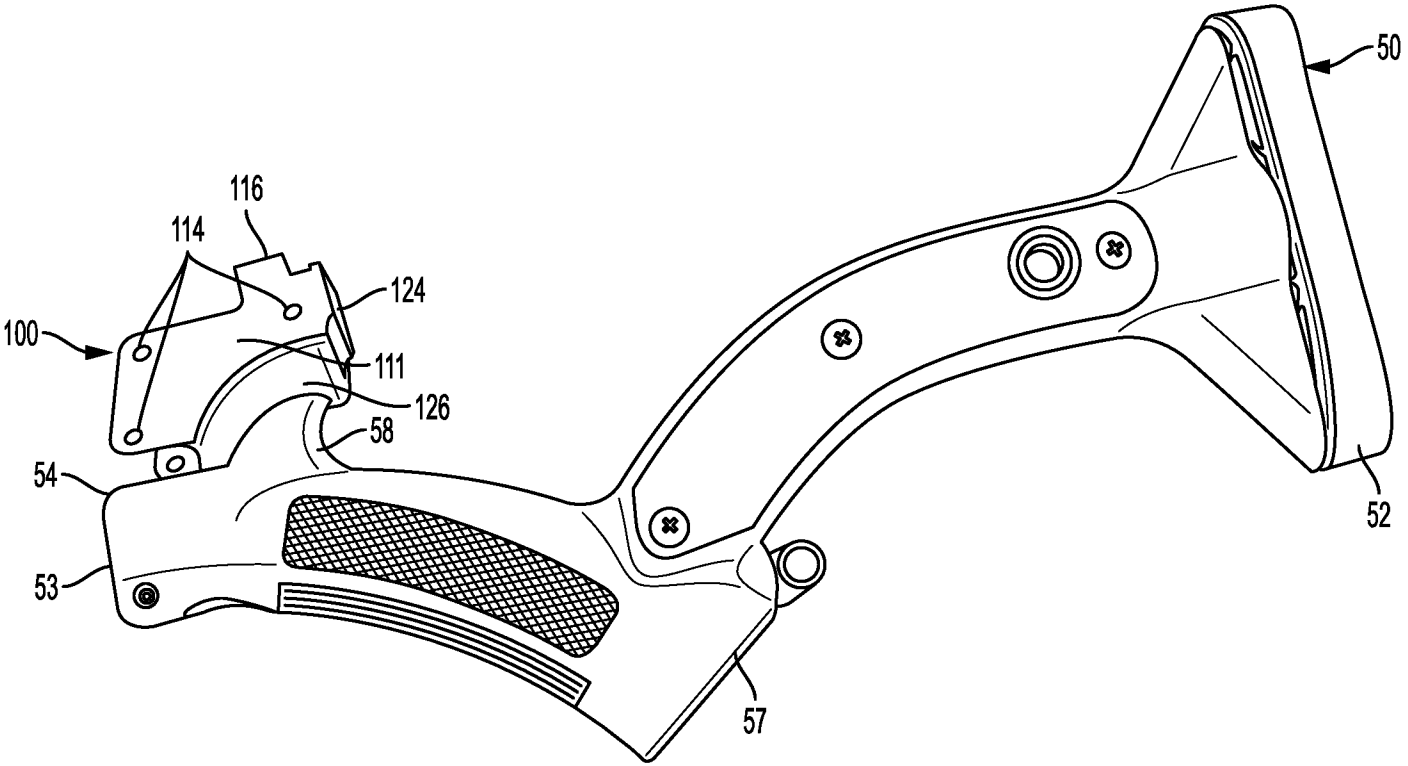
FIG. 10 illustrates an embodiment of the fixed stock adapter installed onto the embodiment of the fixed stock accessory from FIG. 3.

A transition portion 126 may be disposed on the underside of the spine 113 and may be configured to contact the fixed stock accessory 50 (FIGS. 2 and 8-10). As shown in FIG. 10, the transition portion 126 may be congruent with the hand rest 58 (FIGS. 2 and 8-10) of the fixed stock accessory 50 (FIGS. 2 and 8-10) and may be configured to be positioned at least partially within a portion of the fixed stock accessory 50 to create a more secure attachment in the assembled position shown in FIGS. 10-11. When assembled, the transition portion 126 may also aide the user in securely holding and controlling the firearm by extending the hand rest 58 (FIGS. 2 and 8-10). As shown in FIG. 5, the transition portion 126 may be substantially semi-circular such that a cross section may have an arc that is approximately 180°. The transition portion 126 may also comprise an arched configuration along the axis from the forward facing surface 125 to the rearward facing surface 124 that is approximately 90°. The transition portion 126 may also include one or more ridges or grooves 128, which may be configured to engage a portion of the fixed stock accessory 50 and improve the connection between the fixed stock accessory 50 and the fixed stock adapter 100. In an embodiment, the transition portion 126 may include one or more shoulders 127 (FIGS. 3 and 5) that may engage features on the receiver 22 (FIGS. 1 and 7) or may act as a stop to guide the installation of the fixed stock accessory 50 onto the fixed stock adapter 100. Referring to FIG. 4, in an embodiment, the transition portion 126 and the spine 113 may be formed as a single component.

Still referring to FIG. 6, at least a portion of the opposing sides 111 may partially define a cavity having a base comprised of one or more shoulders 112. Referring to FIG. 6, the cavity may have a front portion defined by one or more shoulders 112, a shoulder face 115, the opposing sides 111 and the forward facing surface 125 or spine 113. An aft portion of the cavity may be defined by a base 117 one or more extension portions 121, and an aft surface 119. In an embodiment, the cavity may be configured to at least partially house or surround a portion of the firing mechanism of the firearm. As shown, forward facing surface 125 or spine 113 may be angled to allow the fixed stock adapter 100 to be properly riveted or otherwise attached to the receiver 22 (FIG. 1). In an embodiment, the aft surface 119 may be notched or otherwise configured to engage a portion of the dust cover 21 of the gun (FIG. 7) (FIGS. 1 and 7). In another embodiment, the base components 112, 117 of the cavity may be supported by the spine 113. In still another embodiment, the base 112 of the forward portion of the cavity and the spine 113 may be formed as a single component. One or more of the forward and aft portions of the cavity may be configured to engage or house a portion of the fixed stock accessory 50, the receiver 22 (FIGS. 1 and 7), or one or more components positioned within the receiver 22 (FIGS. 1 and 7). The opposing sides 111 may be spaced apart such that they fit inside a portion of the receiver 22 (FIGS. 1 and 7) and engage the interior of correspondingly opposing sides of the receiver 22 (FIGS. 1 and 7).

Referring to FIGS. 3-6, the accessory engagement portion 130 may be generally positioned below the receiver engagement portion 110 and toward the bottom 108 of the fixed stock adapter 100. As shown in FIG. 6, the accessory engagement portion 130 may be coupled to or extend from the bottom of the spine 113. In another embodiment, the spine 113 and the accessory engagement portion 130 may be formed as a single component. Still referring to FIGS. 3-6, the accessory engagement portion 130 may be a polygon with one or more sides configured to engage a portion of the fixed stock accessory 50 (FIG. 2). The shape and number of sides of the accessory engagement portion 130 may vary according to the type of firearm accessory that is being engaged. The accessory engagement portion 130 is configured to be at least partially disposed inside or fit within a portion of the fixed stock accessory 50. As shown in FIGS. 4 and 6, a bore 135 may extend between a top side 134 and another side of the accessory engagement portion 130. As shown, the bore 135 is angled and extends between the top side 134 and an angled side 132. The bore 135 may be configured to align with a similar hole (not shown) in the fixed stock accessory 50 (FIG. 2). The bore 135 may be further configured to accept a rivet, screw, bolt or other suitable type of mechanical fastener to couple the fixed stock adapter 100 to the fixed stock accessory 50 (FIG. 2). Referring to FIG. 6, the diameter of the top 134 and bottom 131 sides may be less than the diameter of the forward facing surface 125 and the spine 113.

The accessory engagement portion 130 further includes a forward facing side 138 (FIG. 5), and a rearward facing side 136 (FIG. 6). The sides 131, 132, 134, 136, 138, of the accessory engagement portion 130 define an area 139. The sides 131,132, 134, 136, 138 and the area 139 may be dimensioned to prevent axial or radial instability of the fixed stock accessory 50 (FIG. 2) when it is coupled to the fixed stock adapter 100 (FIG. 10). Referring to FIG. 4, the accessory engagement portion 130 is positioned at an angle relative to the receiver engagement portion 110. In an embodiment, the forward facing surface 125 may be disposed at an angle θ relative to a forward facing surface 136 of the accessory engagement portion 130. The angle θ is configured to properly position the accessory engagement portion 130 to engage and be coupled to the fixed stock accessory 50. In an embodiment, the angle θ may be less than 90°, however in another embodiment, the angle θ may not be less than 90°.

Referring to FIG. 7, to assemble the fixed stock adapter 100 with the receiver 22, the fixed stock adapter 100 may be inserted into the receiver 22 such that the transition portion 126 at least partially protrudes from the butt end 46 of the receiver 22. In an embodiment, the one or more grooves 118 (FIGS. 3-6), lips 116 (FIGS. 3-6), or other surface features on the opposing sides 111 of the fixed stock adapter 100 may interact with a surface of the receiver 22 to prevent over insertion or aide in proper alignment. In another embodiment, a portion of the receiver 22 may be cut out or otherwise removed to allow the transition portion 126 to at least partially protrude from the butt end 46 of the receiver 22. The holes 114 may align with holes made in the receiver 22 and are configured to accept one or more fasteners 114'. The one or more fasteners 114' may be rivets, screws, bolts, or any other suitable mechanical fastener to couple the opposing sides 111 of the fixed stock adapter 100 to the receiver 22. In another embodiment, the fixed stock adapter 100 may be coupled to the receiver 22 using one or more welded joints. Still referring to FIG. 7, the accessory engagement portion 130 may be positioned proximate the trigger 28.

Figure 8:
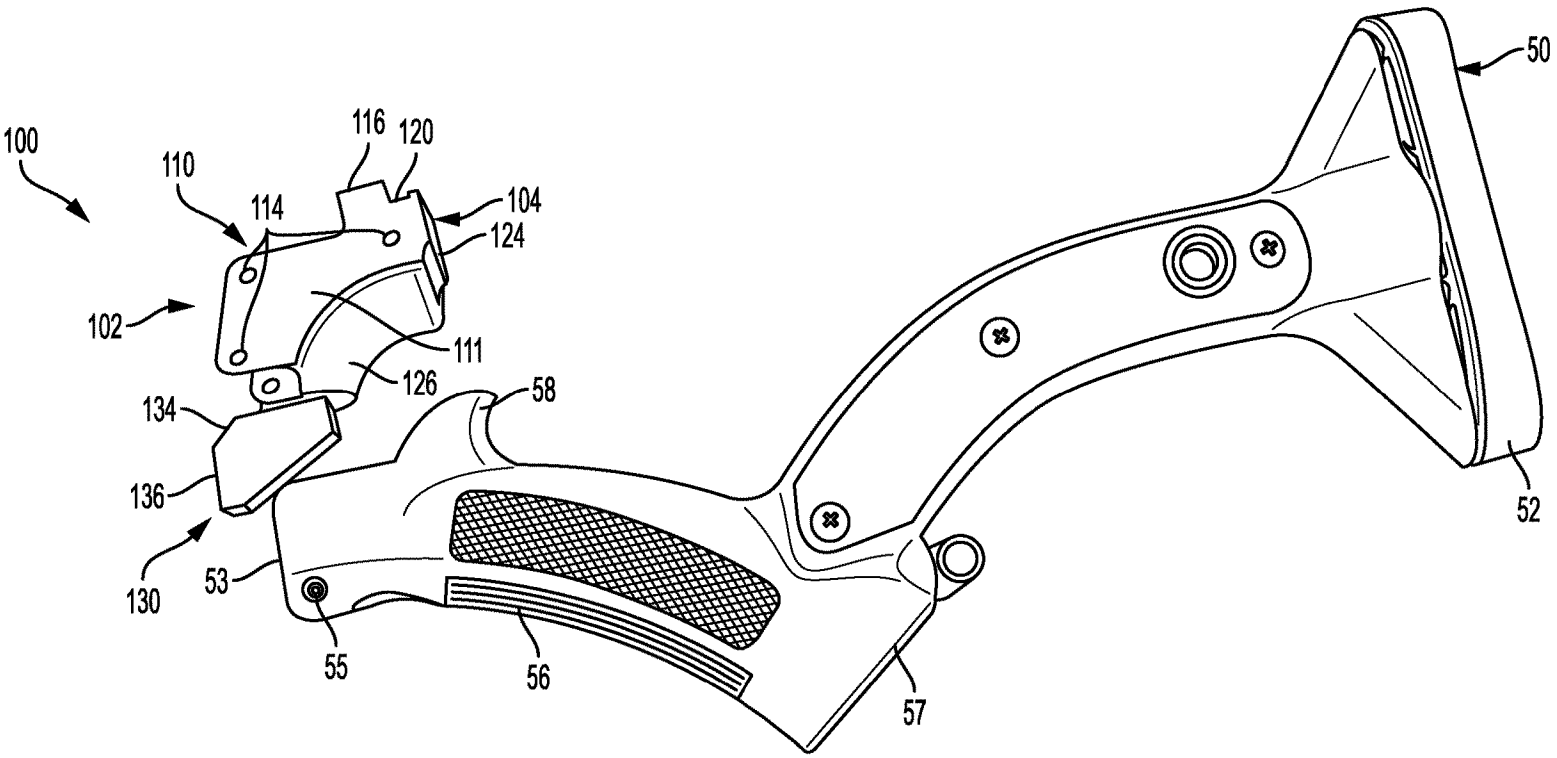
FIG. 8 illustrates an embodiment of the fixed stock adapter and an embodiment of the fixed stock accessory.
Figure 11:
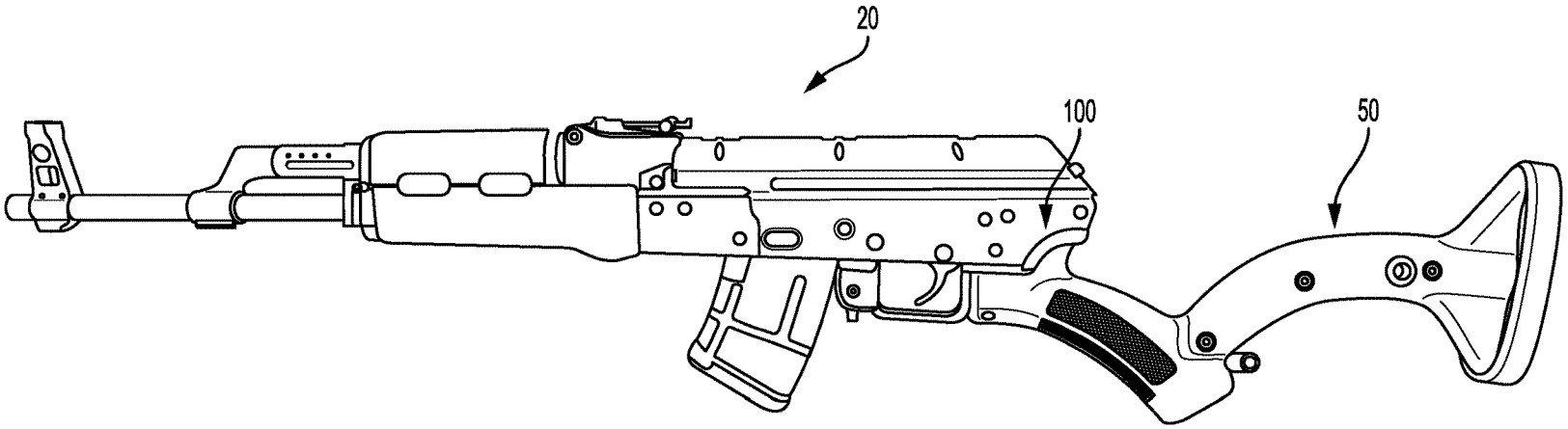
FIG. 11 illustrates an embodiment of the fixed stock adapter being used to couple a fixed stock accessory to the butt end of a receiver of an AK-47 rifle.

As shown in FIGS. 8-10, the fixed stock accessory 50 may be brought into contact and coupled with the accessory engagement portion 130 using a mechanical fastener or any other suitable coupling means. As shown in FIG. 9, the accessory portion 130 is inserted into the end of the fixed stock accessory 50 opposite the butt 52. FIG. 10 illustrates the assembled position of the accessory engagement portion 130 with respect to the fixed stock accessory 50. As shown, the fixed stock adapter 100 is then coupled to the fixed stock accessory 50 using a fastener inserted into the bore 135 (FIGS. 4-6) of the accessory engagement portion 130. The bore 135 (FIGS. 4-6) of the accessory engagement portion 130 may be configured to align with a similar bore or hole in the fixed stock accessory 50 that is configured to receive at least a portion of the fastener. FIG. 11 illustrates the assembled positions of both the receiver engagement portion 110 and the accessory engagement portion 130. It should be appreciated that the steps of assembly illustrated in FIGS. 7-11 may occur in any sequence.

Figure 12:
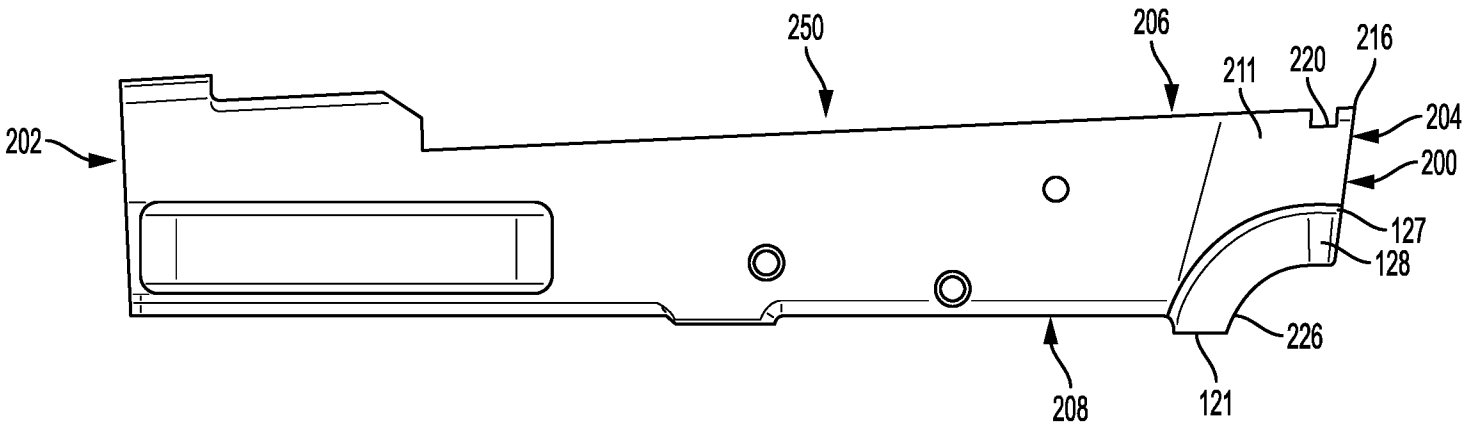
FIG. 12 illustrates a side plan view of an embodiment of a receiver for an AK-47 rifle.
Figure 13:
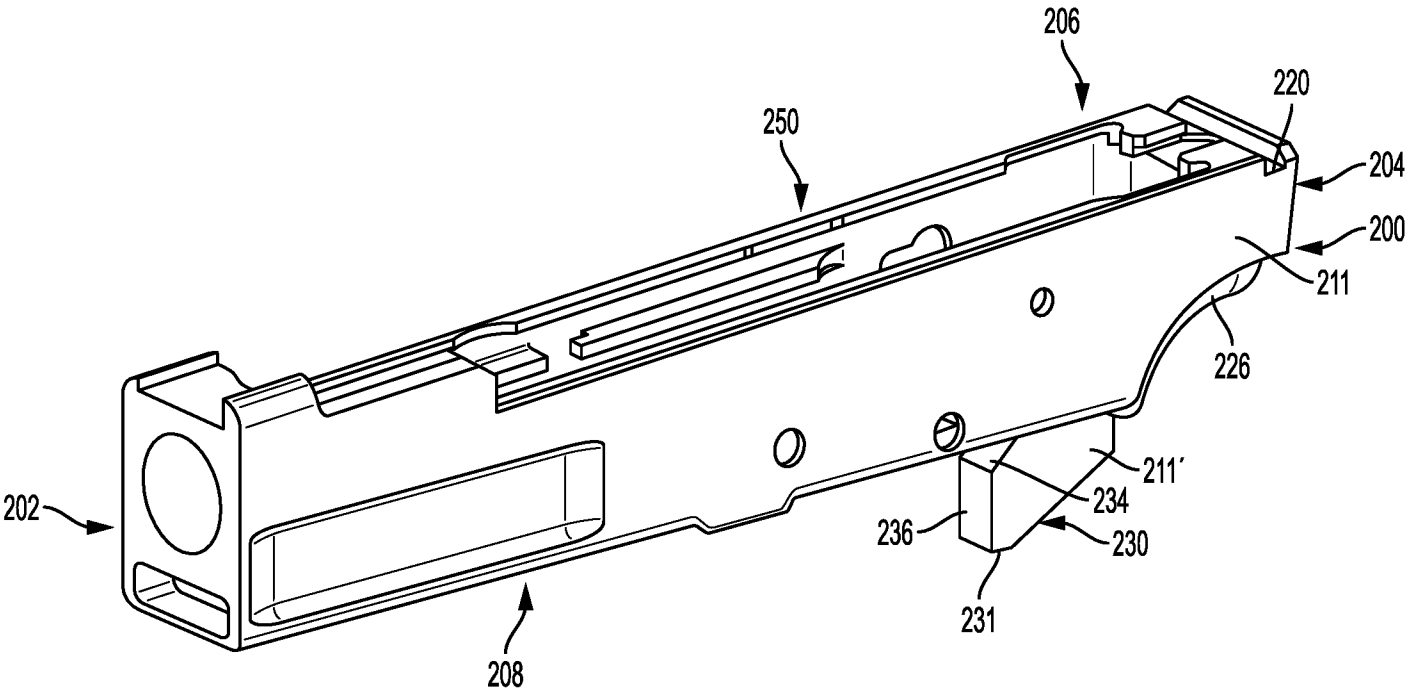
FIG. 13 illustrates an isometric top view of an embodiment of a receiver for an AK-47 rifle.
Figure 14:
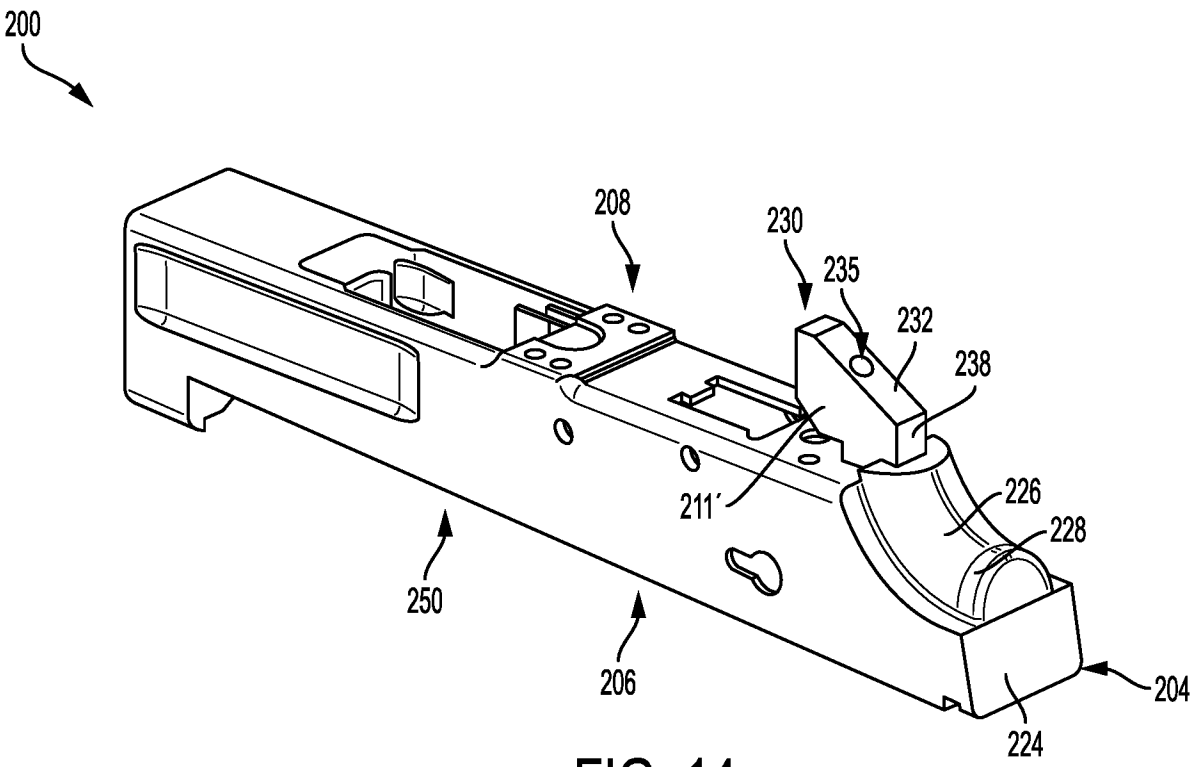
FIG. 14 illustrates an isometric bottom view of an embodiment of a receiver for an AK-47 rifle.

In an embodiment, one or more of the elements of the fixed stock adapter 100 described above may be formed together as a single component. The fixed stock adapter 100 may be comprised of steel, carbon fiber, or any other durable shock-resistant material that can withstand the vibrations associated with firing a round of ammunition. In an embodiment, the fixed stock adapter 100 may be tinted or painted any color Referring to FIGS. 12-14, an embodiment of a receiver 250 comprises a forward end 202 and a rearward end 204. A fixed stock adapter portion 200 may be positioned at the rearward end 204 and may be formed with the receiver 250 as a single component. In an embodiment, the fixed stock adapter portion 200 may have similar features to other embodiments of the fixed stock adapter 100 previously discussed. As shown in FIGS. 12-14, the sides of the receiver 250 may form opposing sides 211 of the fixed stock adapter portion 200. The opposing sides 211 may also comprise one or more surface features that may be configured to engage another element of the firearm, a portion of a fixed stock accessory 50, or an additional accessory. As shown in FIGS. 12-14, the surface features may comprise one or more grooves or recesses, lips 216, and notches 220 proximate the top 206. In another embodiment, the surface features may not be proximate the top 206. Referring to FIG. 12, in an embodiment, the transition portion 226 may be formed with the receiver 250 as a single component, which may be further coupled to an accessory engagement portion 230 using one or more mechanical fasteners or one or more welded joints.

Referring to FIGS. 13-14, in another embodiment, the fixed stock adapter portion 200 may comprise an accessory engagement portion 230 configured to extend from the bottom 208 of the receiver 250. As shown, the accessory engagement portion 230 may have similar features as the embodiments of the accessory engagement portion 130 previously described. The accessory engagement portion 230 may comprise one or more through holes or bores 235 (FIG. 13) configured to accept a rivet, screw, bolt, or other suitable mechanical fastener to couple the fixed stock adapter portion 200 of the receiver 250 to the fixed stock accessory 50 (FIGS. 2 and 8-10). Referring to FIGS. 13 and 14, the one or more bores 235 may extend between a top surface or side 234 and a second side of the accessory engagement portion 230. In the embodiment shown in FIG. 14, the one or more bores 235 extend between a top side 234 and an angled side 232. Referring to FIGS. 13 and 14, the accessory engagement portion 230 further comprises a barrel end facing side 236, an opposing butt end facing side 238, and a bottom side 131. The sides 231, 232, 243, 236, 238 of the accessory engagement portion 230 define an area 211'. As shown, the accessory engagement portion 230 may be coupled to the bottom 208 surface of the receiver 250 by a welded joint. In another embodiment, the accessory engagement portion 230 may be formed as a single unit with the receiver 250.

The surfaces 231, 232, 243, 236, 238 of the accessory engagement portion 230 and the area 211' may be configured to at least partially be disposed within the fixed stock accessory 50 (FIGS. 2, 8-11) when in the installed state. The surfaces 231, 232, 243, 236, 238 of the accessory engagement portion 230 and the area 211' may be dimensioned to limit axial and radial movement of the fixed stock accessory 50 (FIGS. 2, 8-11) and facilitate a more secure attachment between the two components. In an embodiment, one or more of the components of the fixed stock adapter portion 200 may be formed as a single unit with the receiver 250. In a further embodiment, the fixed stock adapter portion 200 may be comprised of the same material as the receiver 250 or may be comprised of a different material and coupled to the receiver 250 using one or more rivets, welded joints, or other suitable means of attachment.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure.

The invention claimed is:

1. A fixed stock adapter for a receiver of a firearm comprising:

a receiver engagement portion disposed at a top end of the fixed stock adapter, the receiver engagement portion comprising, two opposing sides configured to couple to the portion of the receiver, a transition portion proximate the two opposing sides and configured to contact a portion of a fixed stock accessory, the transition portion being congruent with the portion of the fixed stock accessory, a spine configured to couple to the two opposing sides and the transition portion; and an accessory engagement portion disposed at a bottom end of the fixed stock adapter and coupled to the spine, the accessory engagement portion extending from the spine and comprising, one or more accessory engagement surfaces configured to fit within the fixed stock accessory, and at least one coupling feature configured to receive a coupling element, the coupling element configured to engage a coupling feature on the fixed stock accessory.

2. The fixed stock adapter according to claim 1, wherein the firearm is an assault weapon.

3. The fixed stock adapter of claim 1, wherein the receiver engagement portion and the accessory engagement portion are formed as a single component.

4. The fixed stock adapter of claim 1, wherein the at least one coupling feature is a bore extending between a top surface and a bottom surface of the accessory engagement portion.

5. The fixed stock adapter of claim 4, wherein the coupling element is configured to at least partially occupy the bore.

6. The fixed stock adapter of claim 1, wherein the two opposing sides further comprise one or more surface features disposed toward the top end.

7. The fixed stock adapter of claim 1, wherein the spine forms an angle θ with a forward facing surface of the accessory engagement portion that is less than 90°.

8. A receiver for a firearm configured to receive a portion of a barrel, the receiver comprising:

a first end defining an opening configured to receive a portion of a barrel and a second end opposing the first end, the second end comprising a fixed stock adapter portion, the fixed stock adapter comprising, a receiver engagement portion comprising, two opposing sides, a transition portion proximate the two opposing sides and configured to contact a portion of a fixed stock accessory, the transition portion being congruent with the portion of the fixed stock accessory, a spine configured to couple to the two opposing sides and the transition portion; and an accessory engagement portion extending from the spine and comprising, one or more accessory engagement surfaces configured to fit within the fixed stock accessory, and at least one coupling feature configured to receive a coupling element, the coupling element configured to engage a coupling feature on the fixed stock accessory.

9. The receiver according to claim 8, wherein the firearm is an assault weapon.

10. The receiver of claim 8, wherein the receiver engagement portion and the accessory engagement portion are formed as a single component.

11. The receiver of claim 8, wherein the at least one coupling feature is a bore extending between a top surface and a bottom surface of the accessory engagement portion.

12. The receiver of claim 11, wherein the coupling element is configured to at least partially occupy the bore.

13. The receiver of claim 8, wherein the two opposing sides further comprise one or more surface features disposed toward a top end of each opposing side.

14. The receiver of claim 8, wherein the spine forms an angle θ with a forward facing surface of the accessory engagement portion that is less than 90°.

15. An adapter for coupling a fixed stock accessory to a receiver of a firearm, the adapter comprising:

a receiver engagement portion configured to couple to the receiver and comprising, two opposing sides, a transition portion configured to contact a portion of the fixed stock accessory, and a spine configured to couple to the two opposing sides and to the transition portion; and an accessory engagement portion extending from the spine and configured to couple to the fixed stock accessory.

16. The adapter of claim 15 further comprising a forward facing surface and a rearward facing surface, wherein each of the two opposing sides extends from the rearward facing surface to a point beyond the forward facing surface.

17. The adapter of claim 15, wherein the receiver engagement portion and the accessory engagement portion are formed as a single component.

18. The adapter of claim 15, wherein the transition portion is proximate the two opposing sides.

19. The adapter of claim 15, wherein at least one of the receiver engagement portion and the accessory portion are formed as a single component with the receiver.

20. The fixed stock adapter of claim 1 further comprising a forward facing surface and a rearward facing surface, wherein each of the two opposing sides extends from the rearward facing surface to a point beyond the forward facing surface.

* * * * *